US005881786A

United States Patent [19]

Wilderman et al.

[11] Patent Number: 5,881,786

[45] Date of Patent: Mar. 16, 1999

[54] METHOD OF PRODUCING WOOD STRIPS FOR CONVERSION INTO COMPOSITE LUMBER PRODUCTS

[75] Inventors: Ronald C. Wilderman, Sumner; John W. Kerns, Puyallup; Richard E. Wagner, Auburn; Alkiviadis G. Dimakis, Ferderal Way; John S. Selby, Edgewood, all of Wash.

[73] Assignee: Weyerhaeuser Company, Tacoma, Wash.

[21] Appl. No.: 27,021

[22] Filed: Feb. 20, 1998

Related U.S. Application Data

[63] Continuation-in-part of Ser. No. 879,492, Jun. 10, 1997.

[51] Int. Cl.[6] ..... B27D 1/00

[52] U.S. Cl. ..... 144/348; 144/3.1; 144/349; 144/350; 144/351; 144/352; 144/361; 144/364; 144/367; 144/375; 144/378; 144/271; 144/380; 144/381; 156/264; 156/304.1

[58] Field of Search ..... 34/382; 52/693, 52/739.1, 746.1, 692, 642; 156/209, 264, 304.1, 258, 256, 304.5; 144/3.1, 39, 120, 345, 346, 348, 352, 364, 367, 369, 370, 359, 360, 380, 381, 375–378, 271

[56] References Cited

U.S. PATENT DOCUMENTS

| | | | |
|---|---|---|---|
| 3,686,061 | 8/1972 | Brown et al. | 144/352 |
| 3,783,917 | 1/1974 | Mochizuki | 144/175 |
| 3,813,842 | 6/1974 | Troutner | 52/693 |
| 4,633,924 | 1/1987 | Hasenwinkle et al. | 144/242 E |
| 4,653,560 | 3/1987 | Wislocker et al. | 144/242 E |
| 4,691,751 | 9/1987 | Komulainen | 144/357 |
| 4,825,917 | 5/1989 | Gönner | 144/4.9 |
| 4,977,940 | 12/1990 | Gönner et al. | 144/255 |
| 5,010,934 | 4/1991 | Mochizuki et al. | 144/175 |
| 5,052,452 | 10/1991 | Gönner | 144/4.9 |
| 5,069,977 | 12/1991 | Gönner | 428/537.1 |
| 5,088,533 | 2/1992 | Binder | 144/364 |
| 5,318,083 | 6/1994 | Gönner et al. | 144/175 |
| 5,352,317 | 10/1994 | Traben et al. | 156/254 |
| 5,390,716 | 2/1995 | Gönner et al. | 144/175 |
| 5,400,843 | 3/1995 | Gönner et al. | 144/4.9 |
| 5,417,262 | 5/1995 | Gönner | 144/185 |
| 5,427,163 | 6/1995 | Gönner et al. | 144/369 |
| 5,662,760 | 9/1997 | Tsuda | 144/361 |

FOREIGN PATENT DOCUMENTS

| | | | |
|---|---|---|---|
| 23 18 935 | 10/1974 | Germany . | |
| 40 26 349 | 11/1991 | Germany . | |
| 94/29089 | 12/1994 | WIPO | 144/381 |

*Primary Examiner*—W. Donald Bray

[57] ABSTRACT

The invention is a method for producing flitches prepared from roundwood logs, a method for the manufacture of wood slices or slats from the flitches, and methods of combining the strips into composite lumber products. The methods are based in part on the concept of preparing flitches that retain the sweep or natural longitudinal curvature of the log and slicing or sawing around the sweep to prepare the slats for further conversion into composite lumber products. An opening cut is made in the log essentially following or parallel to the curve of any sweep to divide it into two approximately equal volume pieces. An opposing surfaces is machined parallel to the surface generated by the opening cut to produce a flitch. The flitches are then flattened so that the sweep curvature is made planar. They are then sliced or sawn parallel to the now planar surface to produce slats. The natural surface of the log is preferably retained on the sides of the flitches. Slats may then be edged and adhesively combined in various ways to produce composite lumber products. The method achieves an especially high yield from raw logs of products that simulate solid sawn lumber in appearance, properties, and ease of use.

48 Claims, 6 Drawing Sheets

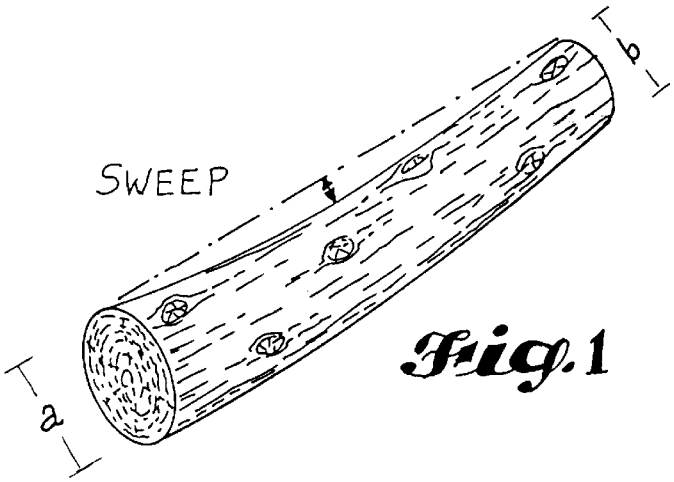
Fig. 1
Fig. 2
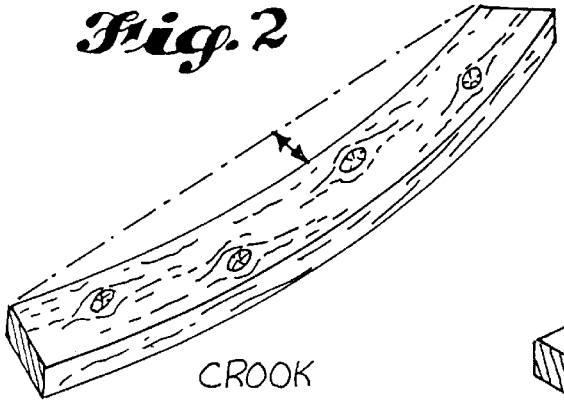
Fig. 3
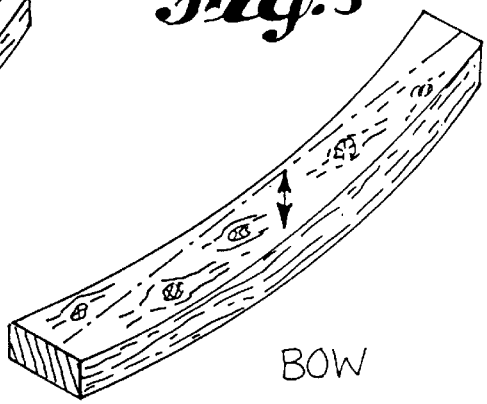
Fig. 4
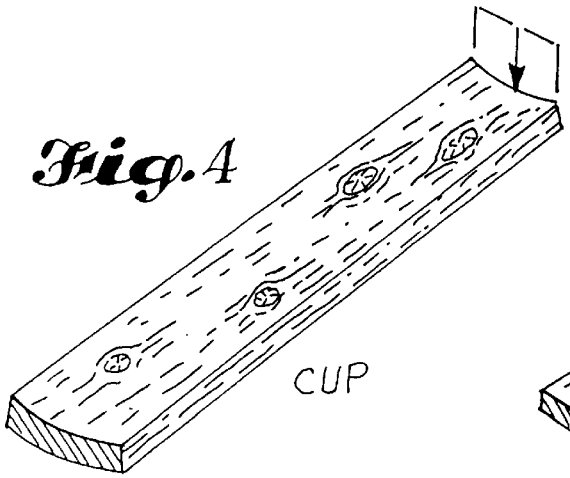
Fig. 5
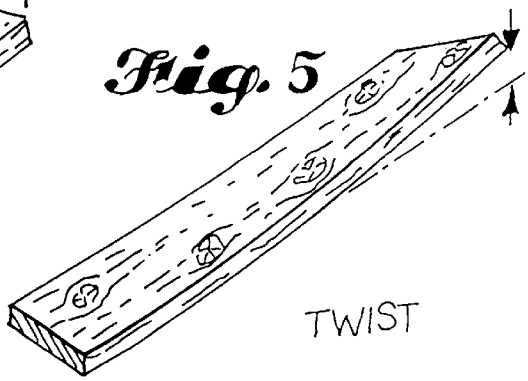

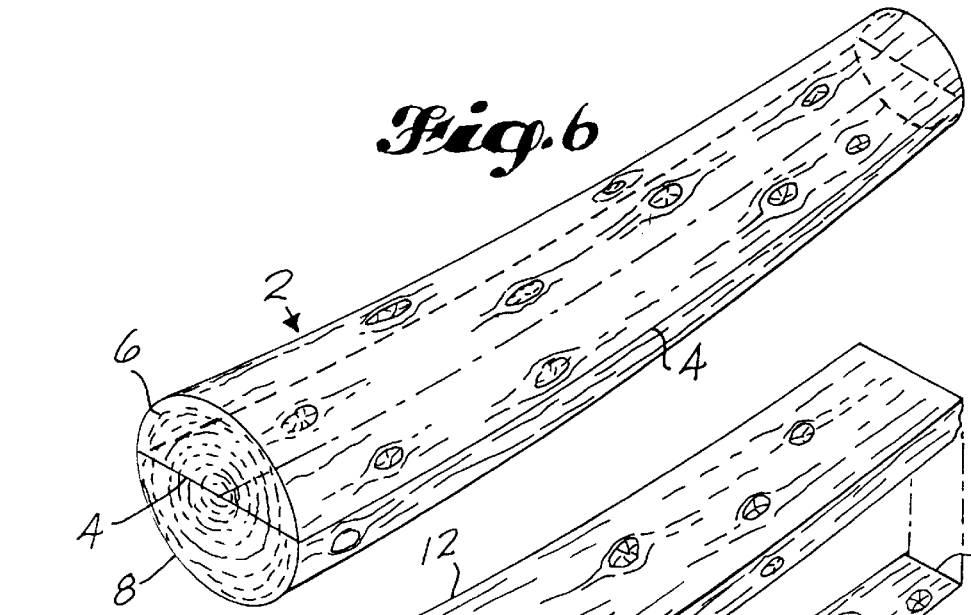
Fig. 6
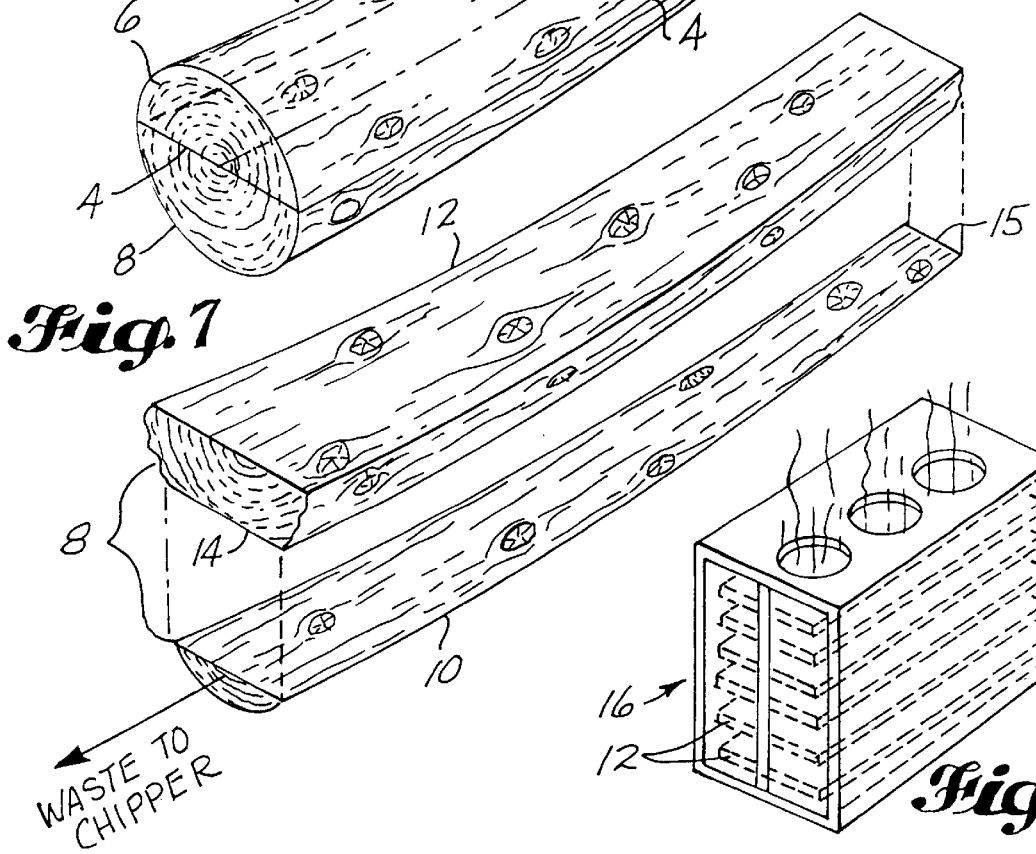
Fig. 7
Fig. 8
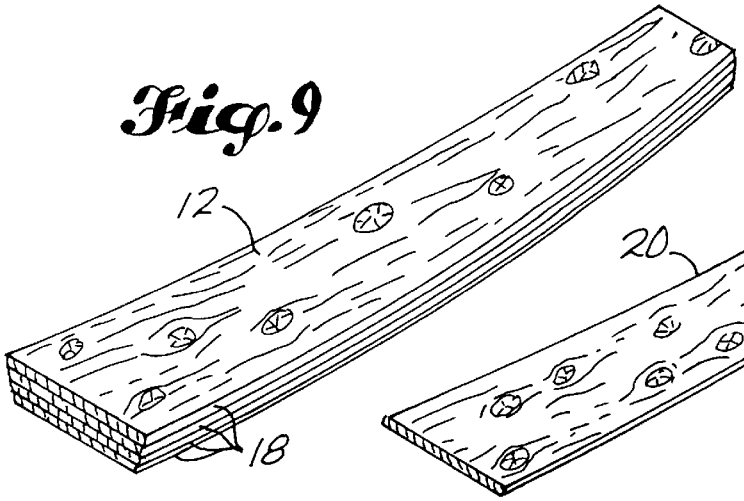
Fig. 9
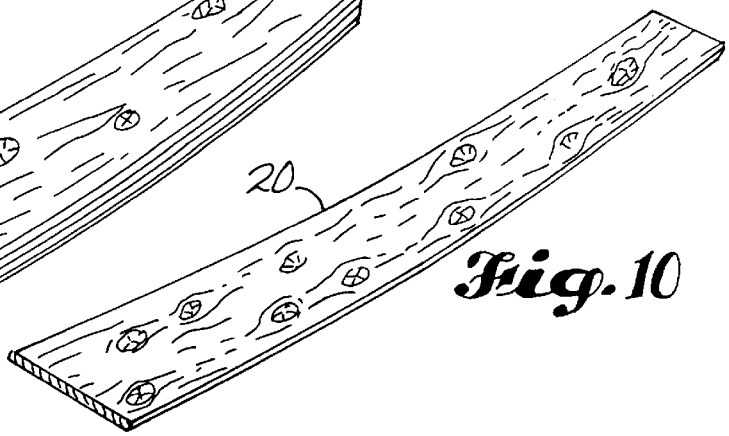
Fig. 10

METHOD OF PRODUCING WOOD STRIPS FOR CONVERSION INTO COMPOSITE LUMBER PRODUCTS

This application is a continuation-in-part of application Ser. No. 08/879,492, filed Jun. 10, 1997.

The present invention is directed to a method for producing wood strips or slats for the manufacture of composite lumber and to methods of combining the strips into composite lumber products. The methods achieve an especially high yield from raw logs of products that simulate solid sawn lumber in appearance and ease of use. The volume of lower value secondary products such as pulp chips or sawdust is minimized.

BACKGROUND OF THE INVENTION

Sawn lumber in standard dimensions is the major construction material used in framing homes and many commercial structures. The available old growth forests that once provided most of this lumber have now largely been cut. Most of the lumber produced today is from much smaller trees obtained from second growth forests and, increasingly, from tree plantations. Intensively managed plantation forests stocked with genetically improved trees are now being harvested on cycles that vary from about 25 to 40 years in the pine region of the southeastern and south central United States and about 40 to 60 years in the Douglas-fir region of the Pacific Northwest. Similar short harvesting cycles are also being used in many other parts of the world where managed forests are important to the economy. Plantation thinnings, trees from 15 to 25 years old, are also a source of small saw logs.

Whereas old growth trees were typically between 0.6 m to 1.8 m in diameter at the base (two to six feet), plantation trees are much smaller. Rarely are they more than two feet (0.6 m) at the base and usually they are considerably less than that. One might consider as an example a typical 35 year old North Carolina loblolly pine plantation tree on a good growing site. The site would have been initially planted to about 900 trees per hectare (400 per acre) and thinned to half that number by 15 years. A plot would often have been fertilized one or more times during its growth cycle. The typical 35 year old tree at harvest would be about 40 cm (16 in) diameter at the base and 15 cm (6 in) at a height of 20 m (66 ft). Trees from the Douglas-fir region would normally be allowed to grow somewhat larger before harvest.

American construction lumber, so-called "dimension lumber", is nominally 2 inches (actually 38 mm (1½ inches)) in thickness and varies in nominal 2 inch (51 mm) width increments from 3½ inches to 11¼ inches (89 mm to 286 mm), measured at about 12% moisture content. Lengths typically begin at 8 feet (2.43 m) and increase in 2 foot (0.61 m) intervals up to 20 ft (6.10 m). Unfortunately, when using logs from plantation trees it is now more difficult to produce the larger and/or longer sizes and grades in the same quantities as in the past.

The smaller trees of today's forests pose additional challenges for the sawmill. Because of their smaller diameter there is inherently a higher percentage of waste in converting them to rectangular lumber. While this waste is often converted into pulp chips, these are of inherently much lower value than the lumber. Also, the physical geometry of the logs is a cause for additional waste. The logs tend to have considerable taper and often have sweep as well. Sweep is longitudinal curvature along the tree. Defined otherwise, it is the deviation from a straight line of the concave edge when the log is allowed to assume its natural position on a flat surface. While occasional occurrences of extreme sweep will occur, most often it will not exceed about 100 mm in a log about 5 m long (about 4 inches in 16 feet). If logs are squared in a conventional manner prior to lumber manufacture, there is significant additional waste from sweep removal. Sawmilling machinery has recently been developed to saw logs parallel to the sweep curvature. Typically the logs are first oriented with the greatest curvature up or down ("horns up" or "horns down") and parallel faces produced on the sides by saws or chipper heads. They are then turned on one of these flat sides and sawn "around the curve". Surprisingly, the resulting boards, though originally containing the curve of the sweep, will flatten during drying. Average lumber recovery using around the curve sawing may approach 12% greater than by using conventional methods. Exemplary equipment for around the curve sawing is shown in U.S. Pat. Nos. 4,633,924 to Hasenwinkle et al. and 4,653,560 to Wislocker et al. Sawmill equipment for around the curve sawing is commercially available from McGehee Equipment Company, Ukiah, Calif. and other vendors.

Veneers have been "sliced" from prepared cants or flitches for many years. In the past, slicing has been limited to thin products, rarely more than about 3 mm in thickness. Since no sawdust is produced in slicing, conversion from flitch to useable product is high. The typical slicer cuts veneers transversely from flitches; i.e., across the width rather than along the length. Often these veneers are from fine hardwoods and are used for furniture, cabinetry, paneling, or in other applications where appearance is important. In many cases these hardwoods may be extremely rare and expensive. Rosewood or walnut would be examples. Sliced veneers enable a product to appear as if it was made from solid wood but at a small fraction of the cost of a solid wood product. Many decorative treatments are possible with sliced veneers that would not be practical or possible with solid sawn woods; e.g., book matched panels.

Rotary cut veneers peeled in a continuous ribbon from logs are primarily used in the production of plywood. This method is less often used for production of thin decorative veneers. Rotary veneer if used as a surface layer is normally used for products of lower ultimate value than those made with sliced veneers. The undistinguished flat grain is esthetically less pleasing than the appearance of sliced veneers. Due the lathe checks produced when the log is peeled, and other restraints, rotary cut veneers are not available in thicknesses much in excess of about 6 mm (¼ inch).

In order to increase conversion percentage of sawlogs to lumber, researchers have over the years looked at methods of kerfless cutting; i.e., cutting by some method that does not use saws and produce wasteful sawdust. An early example would be U.S. Pat. No. 3,327,747 to Collins. High energy lasers have also been suggested for kerfless cutting, as in U.S. Pat. No. 4,402,574 to McConnel. Unfortunately, until recently no practical method has been found other than the manufacture of rotary cut or sliced veneer and the available veneer thickness has limited its usefulness in lumber products. An exception might be found in products such as those described in U.S. Pat. No. 3,813,842 to Troutner where plies of rotary veneer cut to the maximum practical thickness of about 6 mm are laid up with the grain direction parallel to produce lumber-like products.

The picture has changed in recent years as slicers capable of cutting slats up to about 20 mm (¾ inch) in thickness have become commercially available. In contrast to slicers for producing decorative veneers, these generally feed the flitches longitudinally against a fixed knife rather than transversely. The resulting slats have minimal structural damage, such as checks or tears, but may come out cupped or twisted by internal stresses so that they require a subsequent flattening treatment. This may be accomplished by mechanical deformation or by the use of restraint applied during drying. After drying and flattening, the slices may be laid up into panels and the panels subsequently ripped longitudinally to produce lumber-like products in a known manner. Exemplary machines of this type are described in U.S. Pat. Nos. 4,825,917, 5,052,452, 5,318,083, 5,390,716, 5,400,843, and 5,427,163 to Gönner or Göinner et al; 3,783,917 and 5,010,934 to Mochizuki and Mochizuki et al. respectively; and Pat. No. 5,088,533 to Binder. In U.S. Pat. No. 4,977,940, Gönner et al. shows a device for straightening boards or slats produced on slicers of the above type. G önner describes a composite wood member produced from sliced slats in U.S. Pat. No. 5,069,977 as do Traben and G önner in U.S. Pat. No. 5,352,317.

It is normal in using the above slicers to use cants or flitches that have been squared; i.e. formed into rectangular parallelepipeds in which each face is at 90° to its adjacent faces. Because of this, considerable wood is lost from the outside of the log in forming a rectangle of the largest possible cross sectional area from the particular cut being formed into a flitch. This waste includes that due to sweep and taper which must be cut out and used for fuel or other lower value products.

The present method is directed to a process for producing composite lumber products using methods that eliminate much of the waste caused by the sweep and taper naturally present in sawlogs.

SUMMARY OF THE INVENTION

The present invention is an improved method for making wood slices, slats or boards from flitches prepared from roundwood logs. The method significantly increases the conversion of raw logs into useful products and reduces waste. The invention further includes ways for conversion of these slats into lumber-like products. The method is based in part on the concept of slicing around the sweep or natural longitudinal curvature of the log without first having to square the flitch. Alternatively, the slats may be prepared by sawing parallel to one of the major flitch surfaces. The term "slats" should be considered equivalent to slices or boards.

The invention also includes random width edging of the slats and edging configurations wherein the edges of the slats may be at right angles or at some other angle to the faces of the slats.

On larger logs, an opening or initial cut is made in the log essentially following or parallel to the curve of any sweep to divide it into two approximately equal volume pieces. This cut will most typically be along the line described by the pith at the center of the initial growth ring of the tree. However, the cut may be some-what laterally displaced from the pith as long as it is essentially parallel to the sweep curvature. Before, after, or simultaneously when this opening or initial cut is made, the log surfaces are machined to provide opposing surfaces which are parallel to the surface generated by the opening cut and of some prescribed minimum width. Typically, this minimum width will be about 5 cm although particular circumstances might dictate that it be either somewhat wider or narrower. By this procedure, longitudinal taper is removed from only the two parallel face portions but sweep is retained. The edges of the flitch so produced may also be machined into a configuration in which they are parallel to each other, in other words to produce a rectangular cross section. In this way all taper is removed but the sweep is still retained. In the preferred method, little or no machining is done to the edge portions of the flitch and the original log surface will remain. Here, the flitch retains longitudinal sweep and taper and wane along the edges. Alternatively, the edges of the flitch may also be squared or partially squared prior to slicing.

For smaller logs, an initial cut dividing the log into two pieces is not always required. In this case it is only necessary to machine opposing log surfaces parallel to the sweep curvature to create a bowed flitch for further processing.

Some or all of the taper may alternatively be removed from the center portion of the log after the opening cut has been made. This has the advantage that fiber angle in the flitches is more nearly parallel to the surfaces; i.e., cross grain is minimized. However, there is a disadvantage in that more wood is wasted so that this procedure is not normally preferred.

Following initial preparation of the flitches they are preferably treated for a period of time with moist heat so that they are softened or plasticized throughout without significant loss of initial moisture. This may be carried out in steam chambers, by hot water immersion, or by hot water showers as is conventionally practiced. While not always necessary in the present invention, this procedure is commonly used in manufacture of sliced veneers. The moist heat treatment is not required if the flitches are to be sawn.

The conditioned flitches are then ready for slicing or sawing into slats that will be in the thickness range of about 10–25 mm. Immediately prior to or simultaneously with the slicing or sawing process the sweep curvature is removed from the softened flitch by application of pressure. The flitch becomes flattened and the formerly bowed surfaces become planar. Flattening may be done separately from the slicing machine or saws but it is preferably done simultaneously with slicing or sawing. However, the flitches may be initially flattened by application of pressure sufficient to cause at least temporary flattening, as; e.g., by a process similar to the method taught in Gönner et al. U.S. Pat. No. 4,977,940. Slicers made according to the descriptions in several of the aforenoted Gönner et al. patents are available commercially from Firma Gebrüder Linck Machinenfabrik GmbH & Co. KG, Oberkirch, Germany. These machines employ forceful hold down belts to feed the flitches across the slicing knife. Surprisingly, the force of these belts has been found to be sufficient to flatten the sweep present in the incoming flitches. When the terms "slicing-around-the-curve" or "sawing around the curve" are used herein, it does not necessarily mean that the flitch follows a curved path through the slicer or saws. Instead it connotes that the slices or slats are taken parallel to and are of uniform thickness in reference to the flattened surfaces.

After the slats have been sliced or sawn from the flitches they are dried. Since they may have distortions such as twist or cupping a flattening step is also employed at this time. This flattening may be done mechanically, such as by the method in the just above noted Gönner et al. patent. However, it is usually sufficient and preferred to dry the slices or slats while held under restraint sufficient to flatten them. This may be done on continuous dryers where the slats are held between belts or platens or they may be stacked with stickers between them as is done with lumber in conventional dry kilns.

Following drying the slats are edged, i.e. if this was not done earlier during flitch preparation. The original log surface is most usually removed to produce edges at right angles to the faces. Alternatively, the slats may be edged at an angle. This would most usually be a 45° angle but other angles may also be chosen. Edging may be done so that the slats are of uniform width from end to end. A much preferred method is to edge so that any taper is preserved. In this method the end of the flitch nearest to the butt portion of the tree will usually be somewhat wider than the opposite end.

The resulting edged slats may be used in any number of products. While they are useful in their own right; e.g., as boards, in most cases they will be further adhesively combined to make composite lumber products. One way of doing this is described in Gönner U.S. Pat. No. 5,069,977. They may be edge glued into wider panels and individual slats may be finger or scarf jointed to produce longer members. Panels may, in turn, be laid up one upon the other to provide thicker constructions which may then be ripped lengthwise to produce composite lumber products of desired dimensions.

With the tapered slats produced by the preferred method, appropriate slats may be turned end for end in relation to the one placed next to it in a panel as is necessary to maintain essentially parallel sided panels. In this manner much of the taper present in the original log is saved as useable product and not wasted. In none of the products is there waste due to removal of sweep during initial flitch preparation.

The wood in the outer portion of a typical small sawlog is usually of significantly higher modulus of elasticity in flexure than that from the inner portions. This higher modulus wood can be segregated from the weaker wood and placed selectively in products in positions and/or orientations where its greater strength can be best used to advantage. As an example it can be placed adjacent to those surfaces where bending stresses will be highest. Additionally, due to natural or intentional pruning, the wood nearer to the surface of the log may be more free of knots and similar defects so it can also be placed in locations where appearance is important. The present process is well adapted for segregation of the wood from the surface portions, from selected high modulus logs, or from other species for use in engineered composite lumber products. The wide availability of non-destructive testing means enables either slats or flitches to be readily sorted and segregated for stiffness. Similar methods may be used for sorting and selecting entire logs prior to slicing.

It is an object of the present invention to provide a method whereby the percentage yield of a log into useful products can be significantly increased over existing methods.

It is another object to prepare flitches or cants for slicing or sawing by initially sawing a log with an opening cut parallel to the curve of any end-to-end sweep in the log.

It is a further object to prepare relatively thick wood slats by slicing or sawing around-the-curve of a flitch in which any natural sweep in the log has been retained.

It is yet an object to increase useful product yield by preserving the wood in the end-to-end taper found in most logs.

It is still an object to prepare panels by adhesively bonding slats edge-to-edge.

It is yet another object to prepare panels from tapered slats by turning selected adjacent slats end for end so that useful product is retained from the tapered portion.

These and many other objects will become readily apparent upon reading the following detailed description taken in conjunction with the drawings.

BRIEF DESCRIPTION OF THE DRAWINGS

FIG. 1 exemplifies the sweep and taper commonly found in sawlogs.

FIGS. 2–5 show distortions commonly found in lumber products.

FIG. 6 shows position of the initial saw cut made in a log having natural sweep.

FIG. 7 shows how one half of the log is formed into a flitch retaining the natural sweep.

FIG. 8 indicates a heat and moisture conditioning chamber for the flitches.

FIG. 9 indicates how the flitches are sliced "around-the-curve" to form thick veneer slices.

FIG. 10 shows a single thick veneer slice or "slat".

DETAILED DESCRIPTION OF THE PREFERRED EMBODIMENTS

Figure 11A:
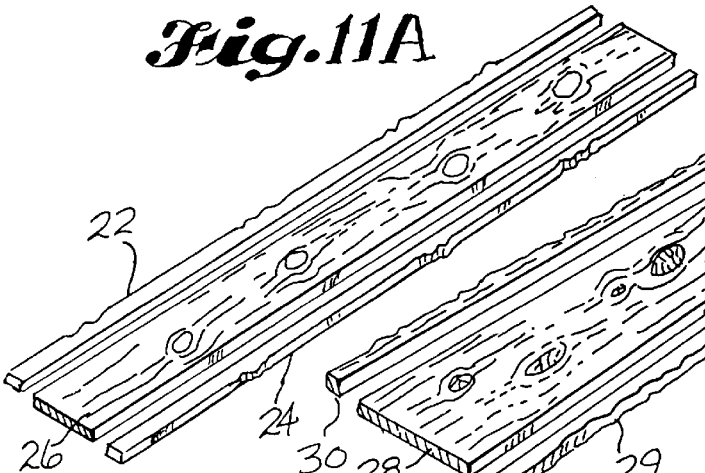
FIGS. 11A and 11B show alternative ways of edging the slats.

The typical logs used in the method of the present invention will be from about 10–30 cm (4–12 inches) at their smaller end and be about 2.4–3.7 m (8–12 feet) long. Taper in 3 m (10 feet) is usually in the range of about 2–4 cm (¾–1 ½ inches) and sweep over this length will usually be about 2.5–5 cm (1–2 inches) although it will be greater in some instances.

Reference now to the drawings will readily show the process of the invention. FIG. 1 exemplifies the sweep and taper commonly found in logs and FIGS. 2–5 show common geometric distortions commonly associated with lumber products. In FIG. 1 taper is indicated by the differences between dimensions "a" and "b". Dimension "a" is larger and would normally be at a point on the tree closer to the ground. The figures should be self explanatory of terms that are occasionally used throughout the application. For the present purposes it is especially important to understand how "sweep" and "bow" differ. Most trees have some natural sweep. This is particularly noticeable in the lower portion of the tree which will constitute the first one or two logs when the tree is harvested. Unfortunately, this also is the portion containing the highest quality wood. Sweep may be severe in trees grown on steep hillsides. Until relatively recently sweep in logs resulted in considerable waste in sawmills and veneer plants. These were essentially designed to handle true cylinders. In sawmills and plants making sliced veneers the largest possible rectangular parallelepipeds were cut from the logs as cants or flitches. The taper and sweep in the log were consigned to pulp chips or waste slabs and edgings useful only for fuel. As was noted earlier, processes now exist for sawing logs "around the curve". The resulting boards are somewhat bowed immediately after sawing but this bow will normally flatten out during drying.

Restraint to hold the boards flat may or may not be needed during subsequent kiln drying.

The present invention is novel in its preservation and utilization of sweep in making sliced veneers. By saving both taper and sweep, yields using the present method run from 15–25% higher than those from conventional practice in which flitches are squared prior to slicing. By only saving sweep up to a 15% yield increase is realized. As seen in FIG. 6, an opening cut 4 is made following the sweep in log 2. Depending on the initial log diameter, this cut may be displaced somewhat from the geometric center in order to obtain the maximum number of slices of the desired thickness. This results in two bowed cants 6, 8 for further processing. FIG. 7 is a representation of the next step in which a slab 10 is removed leaving a flitch 12 having a face 14 parallel to the one created by the opening cut. The slab is normally taken off to leave some minimum width face 15 on the surface of the flitch, shown here on the removed slab. The slab may be removed by sawing or it may be taken off by chipper heads. Thus, taper is removed from the face parallel to the initial cut but not from the edges of the flitch. Alternatively, a cut may be made parallel to the log surface and any taper removed from the face created by the opening or initial cut. This has the advantage of minimizing any cross grain in the flitch but at the cost of somewhat lower yield. As was noted before, the initial or opening cut may not be necessary for smaller logs.

The flitches are then steamed or otherwise treated with moist heat at 16 or hot water immersion, as is common in the sliced veneer industry, until they are softened throughout (FIG. 8). The temperature of this treatment is generally between about 65°–90° C. (150°–190° F.), the higher temperature being preferred, so that the flitch at the time of slicing has an internal temperature of at least about 65° C. If the flitches are subsequently sawn into slats, rather than sliced, the moist conditioning is not required.

The softened flitches may then be directed to a slicer; e.g., one of the type described in the Gönner patents noted before, where a plurality of slices are taken off, as along lines 18 of FIG. 9. The heavy restraining belts of the slicer serve to flatten the softened flitches as they are sliced. The resulting slats 20 (FIG. 10) are normally of varying widths and retain the wane on their edges from the surface of the original log. They also may retain the bow characteristic of the original sweep in the log and other deformities such as cup and twist introduced by slicing or natural internal stresses. All of these deformities can normally be removed by the application of some restraint during drying.

Figure 11B:
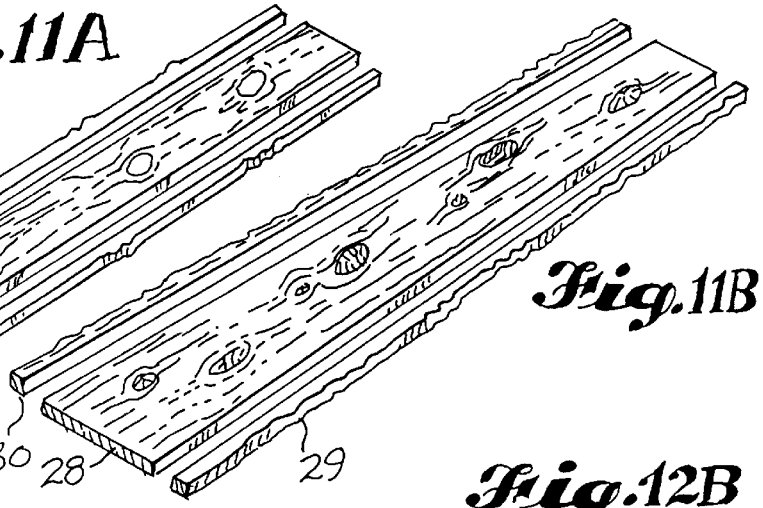

After drying the slats are edged to remove wane. This can be done in one of two ways, as shown in FIGS. 11A and 11B. In FIG. 11A any taper 22, 24 is removed during edging to leave a slat 26 having parallel edges. In FIG. 11B the longitudinal taper is retained to the maximum extent in slats 28. Edge trim 29, 30 significantly reduced. Edging may be done before or after drying.

Figure 12A:
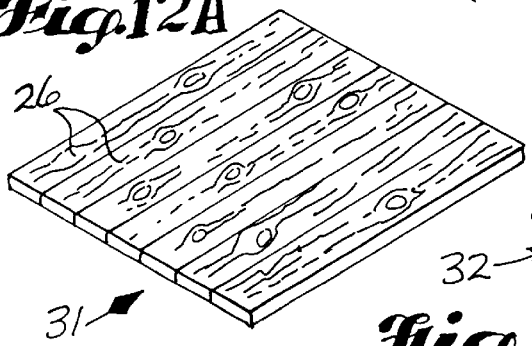
FIGS. 12A and 12B show how the slats are laid up into panels.
Figure 12B:
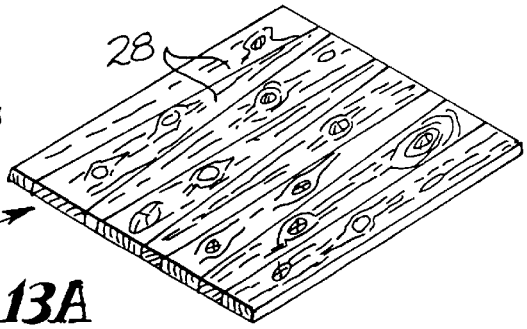

The resulting slats of varying widths can be treated in numerous ways following edging. One preferred treatment is to bond them edge-to-edge into panels 31, 32, as seen in FIGS. 12A and 12B. For sake of clarity, taper is overly emphasized in FIGS. 12B and 13B. Tapered slats 28 are normally laid up with every other slat turned end for end so that the resulting panels 32 need only superficial trimming to retain a rectangular form. Occasional slats may be oriented differently in order to maintain approximate parallelism of the panel edges as they are formed.

Figure 13A:
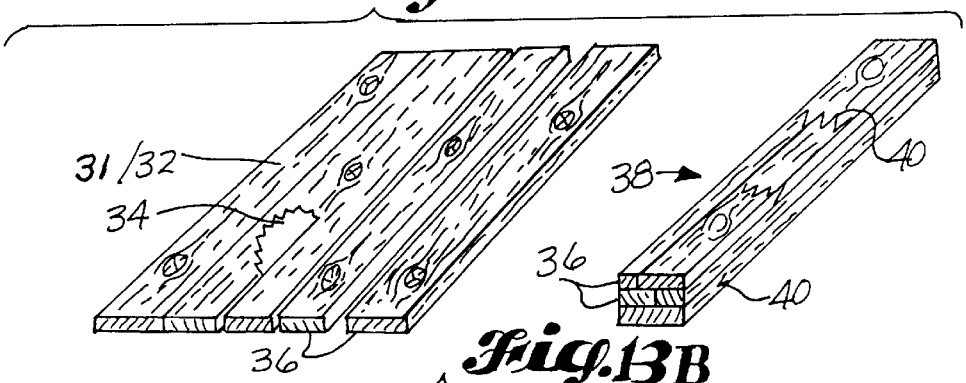
FIGS. 13A and 13B show alternative ways in which the panels may be formed into lumber products.
Figure 13B:
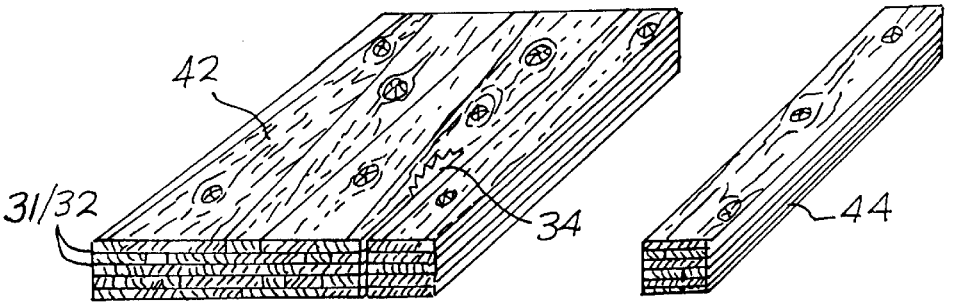

The glued up panels may also be treated in a number of ways to produce the ultimate products, as is seen in FIGS. 13A and 13B. In FIG. 13A the panels 31, 32 are ripped by a saw 34 to produce board-like pieces 36 of uniform width. These may be laminated face to face to produce members 38 of any desired thickness. The resulting members may be end jointed to produce longer members of any desired length. Alternatively, the individual slats can be end joined, as by finger joints 40, so that lumber-like products of any length can be produced. Also, as seen in FIG. 13B, the panels can be face bonded and ripped to width by saw 34 into lumber-like products 44.

Figure 14:
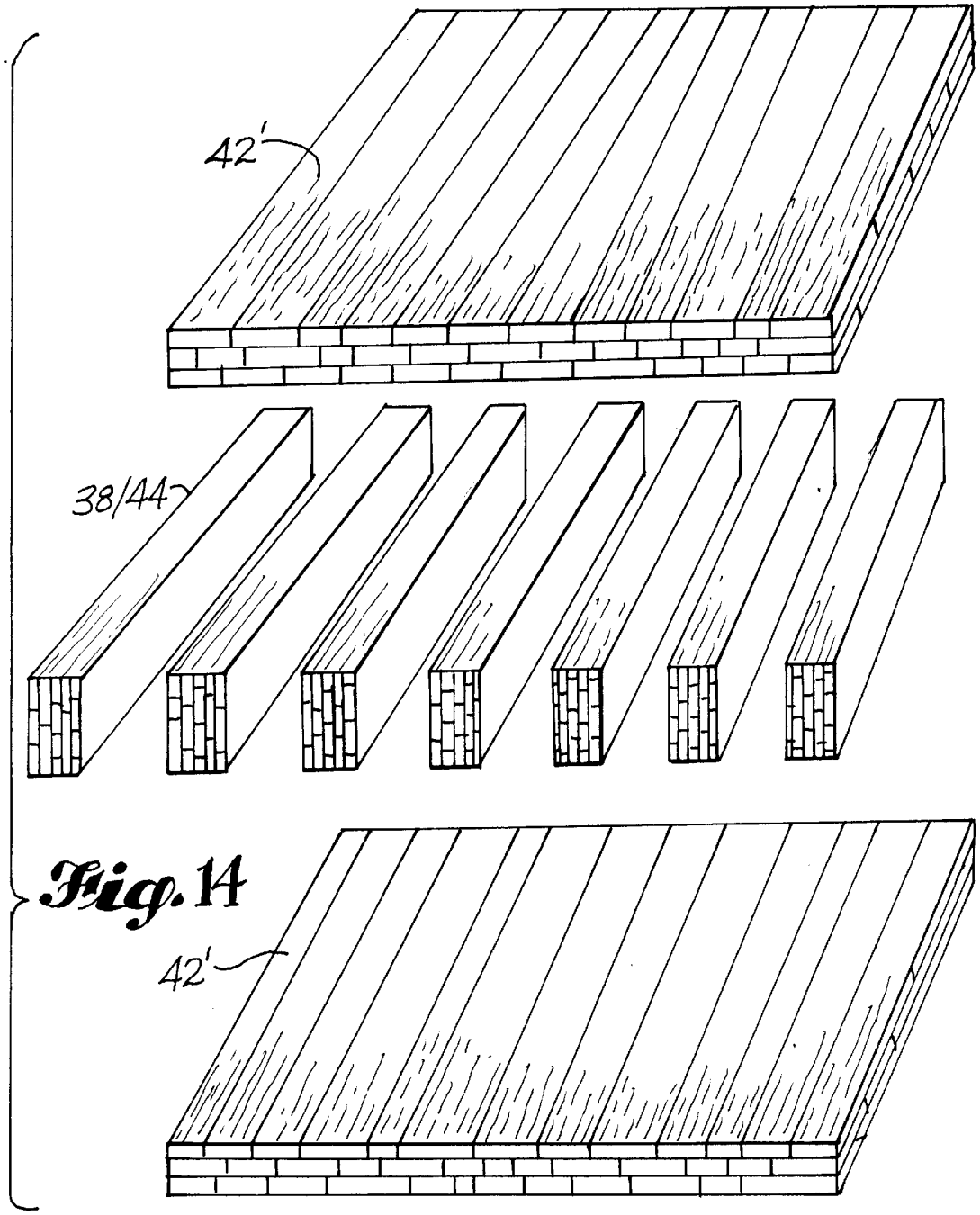
FIG. 14 is an exploded view showing yet another way in which the slats may be assembled into panels.
Figure 15:
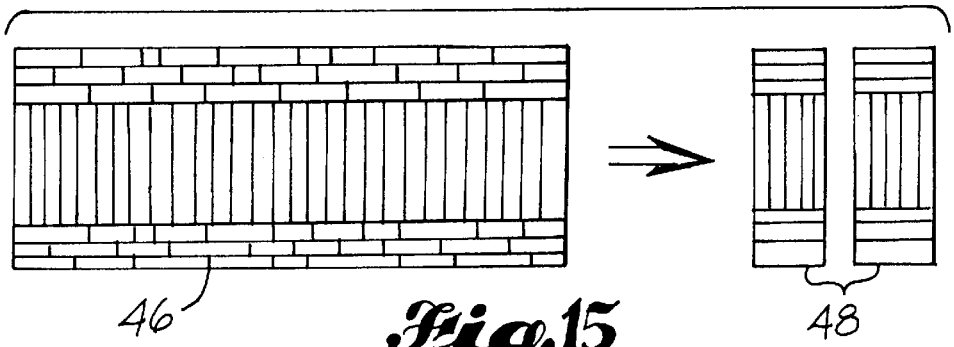
FIG. 15 illustrates how the panels of FIG. 14 are further formed into lumber products.

FIGS. 14 and 15 illustrate another way in which the slats may be laid up to form panels which are subsequently formed into lumber products. As seen in FIG. 14, the lumber products 38 or 44 of FIGS. 13A or 13B respectively are rotated 90° and bonded face-to-face to form thick wide panels 43. To one or both faces of these thick panels are further bonded panels 42', such as are formed and shown in FIG. 13B. This creates a structure 46 shown in FIG. 15. That product is then ripped into lumber products 48 of appropriate width. A particular advantage of this procedure is the ability to place material selected for higher strength in the panels 42'. The higher strength wood is ultimately located in the principal stress bearing portions of lumber product 48.

Figure 16:
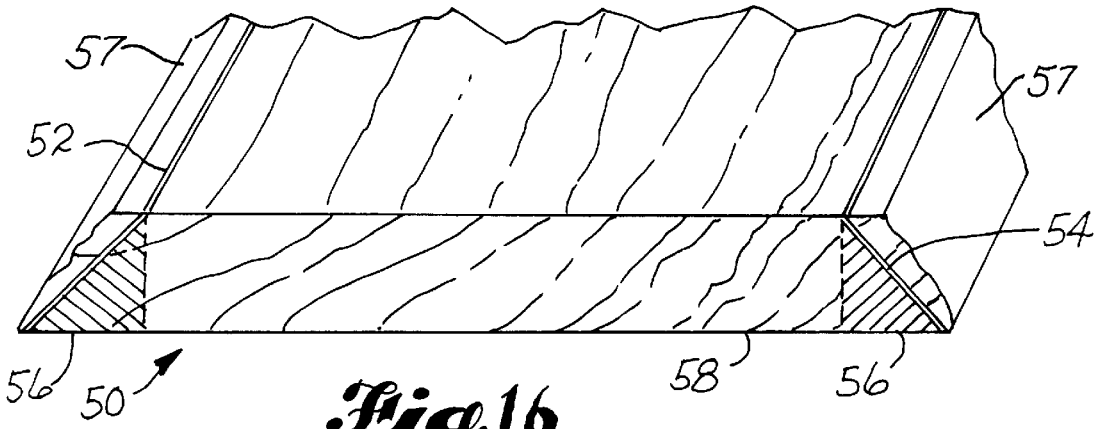
FIGS. 16 and 17 show an additional way of edging the slats and assembling them into panels
Figure 17:
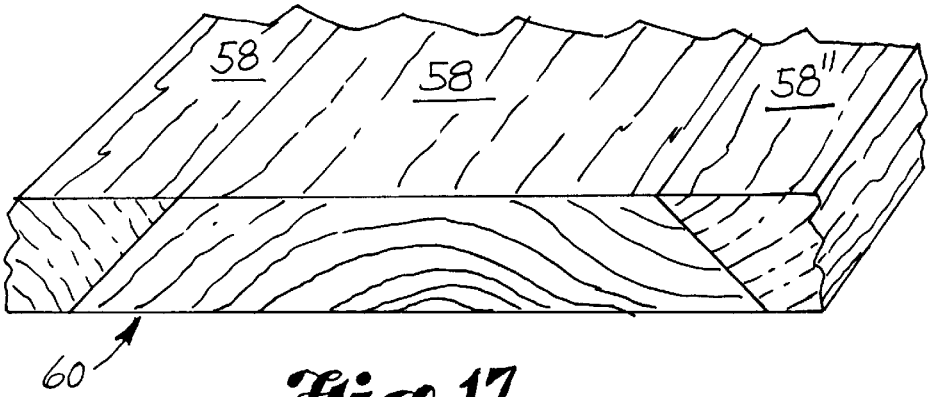

Another method of edging that will further reduce trim waste is seen in FIGS. 16 and 17. Slat 50 is edged at 45° relative to the widest face along saw lines 52, 54 so that trim strip volume is minimized. The wood volume shown in the shaded area 56 is thus preserved as useful lumber and only the narrow edgings 57 go to lower value products. The resulting edged slats 58, 58', and 58" are alternately turned over 180° and bonded edge to edge to form panels 60.

Figure 18:
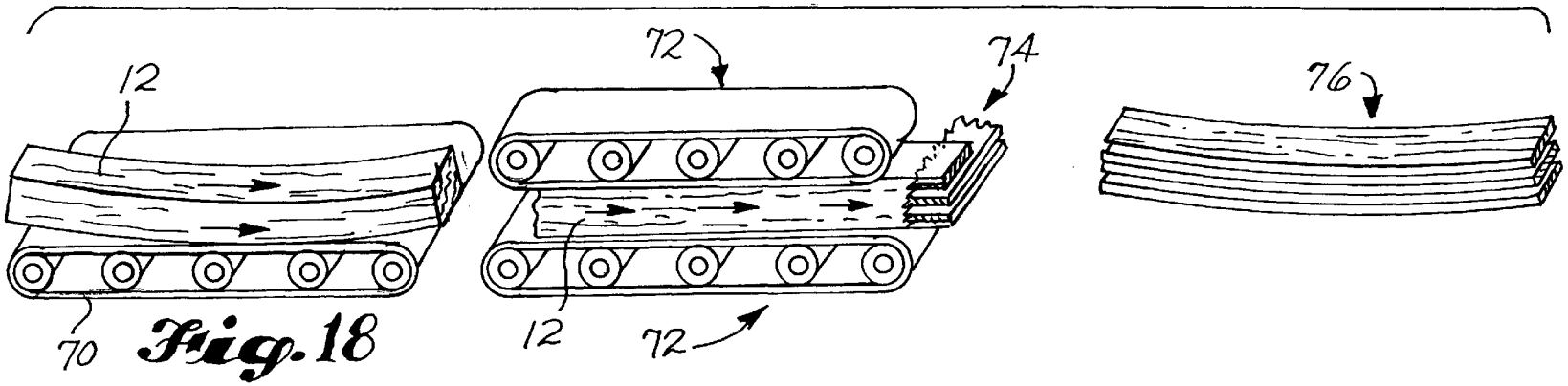
FIGS. 18 and 19 show an alternative method of preparing the slats by sawing rather than slicing
Figure 19:
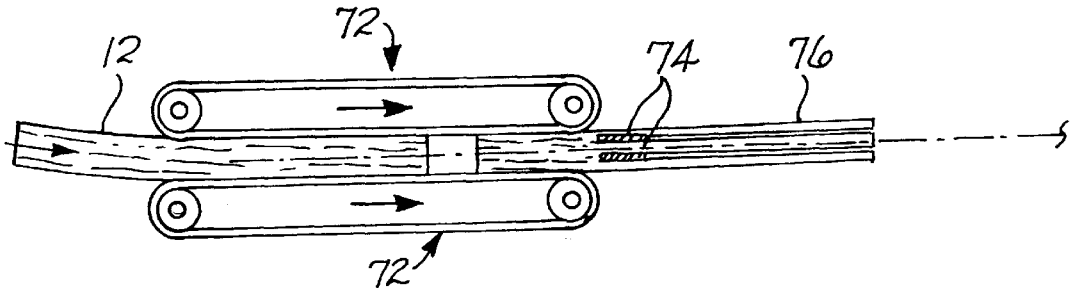

Alternatively, as shown in FIGS. 18 and 19, the flitches 12 traveling on a conveyor 70, may be flattened between the belts of a press 72 and directed into a sawing mechanism 74 to prepare the slats 76. The sawing mechanism will preferably be a gang saw with multiple blades so that all the slats can be prepared in a single pass, although other sawing mechanisms may also be used.

Having thus described the best mode of the invention presently known to the inventors, it will be apparent to those skilled in the art that many minor variations not described herein can be made without departing from the spirit of the invention. Thus, the scope of the invention should be determined only as it is limited by the following claims.

We claim:

1. A method of making wood slats from roundwood logs having end-to-end sweep which comprises:

making an opening cut in the log essentially parallel to the curve of the sweep in the log to divide the log into two portions:

machining the log portions to remove taper normal to the opening cut to create flitches having uniform thickness while retaining the sweep curvature;

flattening the flitches;

removing slats from the flitches parallel to the flattened surfaces; and drying and flattening the slats to remove any residual curvature.

2. The method of claim 1 in which the outer surface of the log portion is machined parallel to the opening cut to remove any taper and create flitches with parallel faces.

3. The method of claim 1 in which the outer portion of the log surface is machined to produce a minimum width face and at least some of any taper is removed from the surface produced by the opening cut.

4. The method of claim 1 in which the opening cut is essentially along the line of the pith of the log.

5. The method of claim 1 in which the opening cut is laterally displaced from the line of the pith of the log.

6. The method of claim 1 in which the log surfaces are machined prior to making the opening cut.

7. The method of claim 1 in which the log surfaces are machined after making the opening cut.

8. The method of claim 1 in which the log surfaces are machined simultaneously with making the opening cut.

9. The method of claim 1 in which the slats are sliced from the flitches.

10. The method of claim 1 in which the slats are sawn from the flitches.

11. The method of claim 1 in which the slats are edged subsequent to drying.

12. The method of claim 1 in which the slats are edged prior to drying.

13. The method of claim 1 in which the slats are edged in a manner to preserve any taper present from end to end.

14. The method of claim 13 in which a plurality of edged slats are bonded edge-to-edge to form panels.

15. The method of claim 14 in which selected alternate slats are turned end for end prior to bonding.

16. The method of claim 1 in which the slats are edged so as to leave the edges in a parallel relationship.

17. The method of claims 13 or 16 in which the slats are edged at 45° to the widest face.

18. The method of claim 16 in which the slats are end jointed to form longer pieces.

19. The method of claim 16 in which a plurality of edged slats are glued edge-to-edge to form panels.

20. The method of claim 18 in which a plurality of edged slats are glued edge-to-edge to form panels.

21. The method of claims 14, 15, 19, or 20 in which the panels are adhesively laminated one upon the other.

22. The method of claim 21 in which the laminated panels are ripped lengthwise to produce composite lumber products.

23. The method of claim 22 in which the composite lumber products are end jointed to form longer products.

24. The method of claims 14, 15, 19, or 20 in which the panels are ripped longitudinally to form strips of essentially uniform width and the strips are laminated to produce composite lumber products.

25. The method of claim 24 in which the composite lumber products are end jointed to form longer products.

26. The method of claim 9 in which the flitches are sliced longitudinally.

27. The method of claim 26 in which the flitches are softened by heat and moisture.

28. The method of claim 27 in which the flitches are flattened prior to slicing.

29. The method of claim 27 in which the flitches are flattened within the slicing machinery.

30. The method of claim 1 in which slices largely from the outer portion of the log are segregated from those having wood predominantly from the inner portion of the log.

31. The method of claim 30 in which the slats are formed into laminated products in which the slats from the outer portion of the log are selectively located to maximize strength.

32. The method of claim 1 in which the slats are sorted for stiffness based on nondestructive testing methods.

33. The method of claim 1 in which the flitches are sorted for stiffness based on nondestructive testing methods.

34. The method of claim 1 in which the logs are sorted for stiffness based on nondestructive testing methods.

35. The method of claim 1 in which the opening cut divides the log into two approximately equal portions.

36. A method for making wood slats from roundwood logs having end-to-end sweep which comprises:

machining opposite sides of the log parallel to the sweep curvature to remove taper and create flitches having uniform thickness while retaining the sweep curvature;

flattening the flitches to remove the sweep curvature;

removing slats from the flitches parallel to the flattened surfaces; and drying and flattening the slats to remove any residual curvature.

37. The method of claim 36 in which the slats are edged subsequent to drying.

38. The method of claim 36 in which the slats are sawn from the flitches.

39. The method of claim 36 in which the slats are sliced from the flitches.

40. The method of claim 36 in which the slats are edged prior to drying.

41. The method of claim 36 in which the slats are edged in a manner to preserve any taper present from end to end.

42. The method of claim 41 in which a plurality of edged slats are bonded edge-to-edge to form panels.

43. The method of claim 42 in which selected alternate slats are turned end for end prior to bonding.

44. The method of claim 36 in which the slats are edged so as to leave the edges in a parallel relationship.

45. The method of claims 41 or 44 in which the slats are edged at 45° to the widest face.

46. A method for making wood slats from roundwood logs having end-to-end sweep which comprises:

making an opening cut in the log essentially parallel to the curve of the sweep in the log;

machining the log surface parallel to the opening cut to remove any taper normal to the opening cut to create flitches having uniform thickness while retaining the sweep curvature;

removing slats from the flitches parallel to the flat surfaces;

drying and flattening the slats to remove any residual curvature.

47. The method of claim 46 in which the slats are sliced from the flitches.

48. The method of claim 46 in which the slats are sawn from the flitches.

* * * * *